United States Patent [19]

Mott

[11] 4,027,602

[45] June 7, 1977

[54] COMBUSTION SYSTEM

[76] Inventor: James R. Mott, 1028 Royal York Road, Toronto, Ontario, Canada

[22] Filed: Feb. 13, 1976

[21] Appl. No.: 657,924

[52] U.S. Cl. ..... 110/7 R; 110/28 J; 110/10; 110/119

[51] Int. Cl.[2] ..... F23G 7/00

[58] Field of Search ..... 110/7 R, 7 A, 18 R, 110/18 C, 10, 28 J, 102, 119

[56] References Cited

UNITED STATES PATENTS

| | | | |
|---|---|---|---|
| 1,874,487 | 8/1932 | Franklin | 110/28 |
| 2,614,513 | 10/1952 | Miller et al. | 110/7 |
| 3,022,753 | 2/1962 | Montgomery | 110/102 |
| 3,050,202 | 8/1962 | Funk | 110/7 |
| 3,387,574 | 6/1968 | Mullen | 110/7 |

*Primary Examiner*—Kenneth W. Sprague

[57] ABSTRACT

A combustion chamber capable of being directly fueled with green bark, green sawdust and the like material formed of refractory material, the chamber having a grate therein at the feed end thereof disposed towards the bottom of the chamber and a reduced outlet and having means for delivering particles of fuel material generally downwardly towards the grate while separating and enveloping the particles with pressurized turbulent air, and means for directing air upwardly through the grate against the downwardly directed air enveloped fuel particles in sufficient volume and with sufficient pressure and velocity to effect turbulent suspension of a substantial proportion of the fuel particles above the grate, the chamber further being air tight apart from the fuel and air input feeds and the outlet whereby the chamber is adapted to operate on a positive pressure with respect to the external ambient pressure.

9 Claims, 3 Drawing Figures

COMBUSTION SYSTEM

FIELD OF THE INVENTION

This invention relates to a novel combustion system and chamber therefor which renders it possible to directly use as the sole fuel "wet" fuel such as chunks of green bark, peat, begasse, as well as particle wet fuels such as green sawdust, nut hulls, rice husks or practically any other wet or green material which contains B.T.U's.

BACKGROUND OF THE INVENTION

In view of the growing scarcity of conventional energy and fuel sources and the rapidly rising cost of same it has become increasingly important to find low cost fuel sources. While it has been recognized that many presently classified waste products do contain heat values, or B.T.U's. if they could be used as a fuel, no one to date as far as I am aware has been able to use same directly as fuel and effect direct automatically controlled combustion thereof because of the high moisture content. Thus for example, chunks of wet or green bark, begasse, and the like, have not been considered as fuels since heretofore they have not been combustible without first being subjected to an uneconomical drying operation or used in conjunction with other non-wet fuels. As a result, such green or wet materials have, in general, been looked upon as waste products which must be disposed of, often at some considerable expense.

It is the object of this invention to provide a combustion system and chamber therefor wherein such wet or green materials can be directly used as fuel without any prior drying operation to provide important new low cost fuel sources while at the same time eliminating the disposal costs of such materials.

It is a further object of the invention to provide a combustion system as aforesaid which, once started, can be automatically controlled to meet the desired heat demand.

BRIEF DESCRIPTION OF THE INVENTION

According to the present invention, combustion of wet or green materials is achieved by feeding pieces or particles of the material separated and enveloped in a turbulent pressure air stream generally downwardly towards a grate zone in a refractory combustion chamber operated at positive pressure with respect to the external atmosphere and at a temperature above the volatilization and ignition temperature of at least some of the constituents of the feed fuel material and directing up through the grate a stream of air having sufficient volume, pressure and velocity to maintain a substantial proportion of the pieces or particles in turbulent suspension over the grate for a time sufficient to initiate volatilization, drawing or driving off and ignition of constituents of the fuel pieces or particles, whereupon a random temperature increasing chain reaction like ignition of the pieces or particles is effected.

A refractory combustion chamber or system according to the invention is constructed and arranged to operate on the above principles.

Further according to the invention, the time of combustion for effecting substantially complete particle combustion is increased by reducing the outlet from the combustion chamber to provide at least a degree of restriction to the escape of the products of combustion.

As will be understood, the heat values of the products of combustion produced in the combustion chamber can be utilized for any of the usual purposes such as providing the heat source for a fire tube or a water tube boiler or such products of combustion, cooled to the appropriate temperature and processed through a suitable grit arrestor, may be used to operate any desired drying kiln for drying lumber, animals feeds and the like.

It has been found that even though wet or green fuel is used to feed the combustion chamber in accordance with the invention, substantially complete combustion is achieved and the system is effectively smokeless and the products of combustion after their heat value has been usefully extracted and after passing through a suitable grit arresting system, can be discharged to the atmosphere without offending pollution standards.

Moreover, it has been found that, once the combustion system or chamber of the invention has been operating, the heat retention of the refractory material together with the absence of any undesired infiltration of cooling air, enables the fuel and combustion air feed to be shut off for an extended period while retaining the internal temperature above the temperature of the fuel. That is, the fuel and combustion air can be shut off when the desired temperature or pressure is reached and can be restarted simply by recommencing fuel and combustion air feed. Thus the system lends itself to automatic regulation in the same manner as conventional oil or gas fired systems.

DETAILED DESCRIPTION OF THE INVENTION

Figure 1:
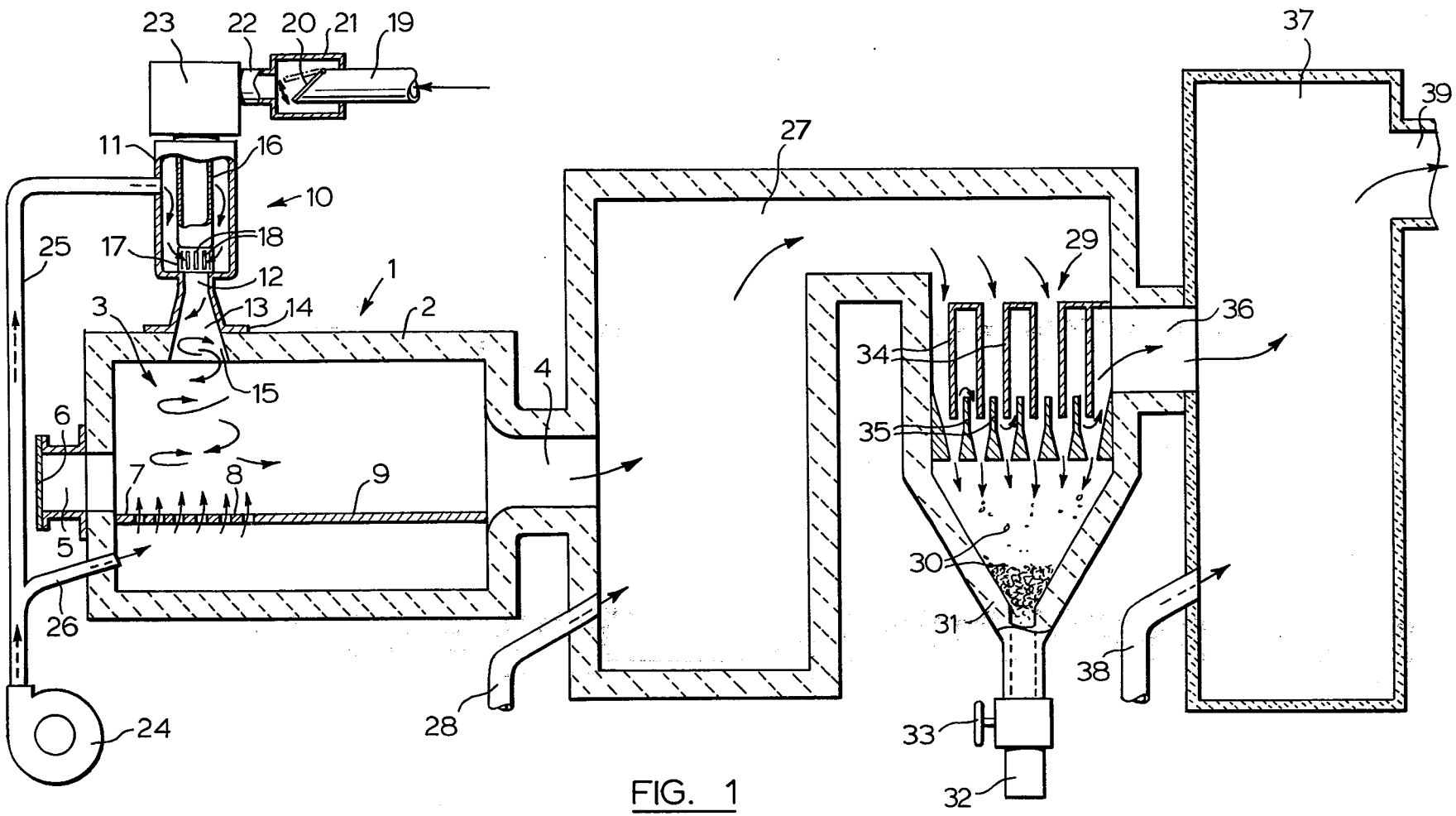
FIG. 1 is a part diagrammatic, part vertical sectional view illustrating a combustion chamber arrangement embodying the invention arranged to supply its combustion products to a direct fired kiln.

The invention will be best understood by reference to the specific embodiment thereof shown in FIG. 1, where there is shown a combustion chamber 1 formed or lined by refractory material 2. The chamber illustrated is generally an elongated cylinder having a fuel input end 3 and a reduced discharge end or outlet 4. It will be understood that the chamber shape may vary but it should have a reduced discharge end.

As illustrated, the input end 3 has an entrance 5 sealed by a door 6, the entrance 5 providing for the introduction of kindling or the like to initiate combustion as hereinafter explained and also providing an inspection opening.

Towards the bottom of the combustion chamber, below the entrance 5, is a short dead plate section 7, a grate section 8 and a dead plate section 9 extending to the outlet 4. Arranged above the grate section 8 is a fuel feed system generally designated at 10. The fuel feed system illustrated which is an effective means of obtaining turbulent air envelopment of the fuel pieces or particles, comprises an outer cylindrical chamber 11 which communicates at its lower end with a short cylindrical discharge section 12 which in turn leads into a frustro conical discharge mouth 13, the feet 14 of which seat on and are sealed against the upper surface of the chamber 1. A frustro conical opening 15 is formed in the top of the combustion chamber and forms a continuation of the frustro conical discharge mouth 13. Within the outer cylindrical chamber 11 is an inner cylindrical chamber 16 which communicates with an annular fuel and air mixing section 17 that opens to the cylindrical section 12 of the outer chamber. The mixer 17 is provided with a plurality of lead in slots 18 to admit air substantially tangentially into the section to cause the air to swirl interiorly within the section.

The fuel to be introduced into the combustion chamber is fed under forced air through a pipe 19 through a gravity operated end flapper valve 20 which opens under the forced air fuel feed but automatically closes under gravity when fuel feed is arrested. The valved end of the pipe 19 is housed in a suitable clean out and inspection chamber designated at 21 and is delivered through pipe extension 22 through a further clean out and inspection chamber 23 into the interior of the inner chamber 16. A blower 24 provides pressure air through tube 25 into the interior of the outer cylinder 11 and through tube 26 into the interior of the combustion chamber 1 beneath the grate section 8. The air flow from the blower 24 is divided by any suitable valve or damper arrangement not shown so that substantially more air is delivered beneath the grate section 8 than to the interior of the outer cylinder 11 of the fuel feed system, with the grate air feed to fuel system air feed being in the ratio of up to about 10:1.

In a typical system according to the invention, as represented by FIG. 1, the interior diameter of the combustion chamber is of the order of 4 to 5 feet and the length of the chamber is of the order of 10 to 12 feet and the fuel feed pipe is of the order of 4 inches in diameter and the fuel which may for example be pieces or particles of wet or green bark, can be of any size up to the largest size which can be delivered under air pressure through the pipe 19.

In addition to green bark, the fuel may also comprise green sawdust, peat, begasse, nut hulls, rice husks or practically any other wet or green material which contains B.T.U's.

As the fuel pieces or particles are delivered down through the inner chamber or cylinder 16 to the mixing annulus 17, they will already be admixed with the air which has propelled the fuel up to that point. At the mixing annulus 17, the pressure air from the tube or pipe 25 delivered into the interior of the outer chamber or cylinder 11 will be forced under pressure through the slots 18 in a tangential manner to effect a rapid swirling of the fuel. This swirling effects separation and air envelopment of the fuel pieces and particles and this action continues down through the expanding frustro conical discharge mouth 13 and combustion chamber entrance 15 into the combustion chamber area above the grate section 8. At this point the fuel pieces or particles already engulfed in air and in turbulent or swirling motion and moving downwardly towards the grate meet a high volume pressure air stream directed upwardly which effects suspension of all but the larger fuel particles in mid air above the grate with only the largest and heaviest of the fuel particles settling onto the grate.

The combustion chamber 1 is made air tight and as a result of the forced pressure air input through the tube 26 beneath the grate and through the tube 25 feeding air to the fuel input system along with the pressure air delivering the fuel itself to the input system, the combustion chamber operates at a substantial pressure with respect to the surrounding ambient atmosphere.

The restricted outlet 4 of the combustion chamber 1 which may be of the order of 2 to 3 feet in diameter delays escape of the contents of the combustion chamber 1 and delays movement of the fuel pieces or particles which are suspended above the grate section 8 away from the grate. This delay assists in achieving combustion as hereinafter more fully described.

To achieve combustion it is simply enough to introduce kindling through the door 6 on to the grate, ignite the kindling and when the kindling is burning well under the forced draft from the blower 24, and the door 6 sealed shut, the temperature within the air tight refractory chamber at the grate quickly reaches the volatilization and ignition temperature of at least some of the constituents of the fuel which may be considerably under 1000° F. In any event, very shortly after the kindling is burning, fuel feed can be commenced. In a very short time, as fuel feed continues, random ignition of a portion of the fuel takes place which in turn effects ignition of other portions until very shortly combustion products at temperatures up to about 3000° F commence discharging through the outlet 4.

While the precise mode of ignition of the fuel is not possible to be determined, it appears that when the fuel particles engulfed in air and turbulently suspended by the upward directed air volume forced up through the grate section 8 are exposed to the temperatures created in the chamber by the kindling, volatilizable constituents of the particles commence being volatilized and driven or drawn off and it is believed that at least some of these constituents contain B.T.U. values and ignite to give off heat which, in turn, volatilizes and drives off other constituents in a temperature increasing chain reaction process until the solid constituents of the particles ignite.

In observing the phenomena in the combustion chamber it appears that in the swirling suspended fuel and air maelstrom there is random swirling fire interspersed with fuel particles which have not yet ignited. It is believed that there are in fact three stages of development taking place simultaneously and at random within the combustion chamber: the first stage of development is the volatilization of the volatilizable constituents of the fuel particles or pieces; the second is the ignition of such of those constituents as contain B.T.U. values to produce an increasing temperature reaction to drive off other B.T.U. containing volatilizable constituents which thereupon ignite to give off their B.T.U. values and finally as a third stage the ignition of the solid constituents. It will be understood that during this chain reaction temperature increasing process the volatilizable non-B.T.U. constituents, e.g. water vapour, will be volatilized and driven off.

The smaller fuel particles or pieces are essentially entirely consumed by the time they have been forced under the internal pressure of the combustion chamber out the discharge outlet 4 while the larger pieces which have not fallen on the grate deposit on the dead plate section 9 where they burn until consumed. Surprisingly the combustion chamber consumes the fuel with substantially no smoke and only with a slight ash occurring in the grate area.

In operating this system depending on how wet or green the fuel is, from about 7 to 15 pounds of air (more air for wetter fuel) is introduced through the tubes 25 and 26 proportioned as above described for each pound of fuel. Each pound of fuel, thoroughly admixed with air, produces substantial B.T.U. values. For instance, green hardwood bark produces about 3,500 B.T.U's. of heat per pound.

While the fuel system 10 is highly effective in achieving the desired separation, air engulfment, and turbulence of the fuel directed downwardly towards the grate, it will be understood that other feed systems which effect intimate and turbulent air and fuel admixtures may be used to carry out the principles of operation of the invention.

FIG. 1 illustrates the use of the products of combustion from the combustion chamber 1 for operating a direct fired kiln for drying such materials as lumber, potato peels or any other material from which moisture is to be extracted under the action of hot gases. Since the products of combustion emanating from the combustion chamber 1 have a temperature of the order of 3000° F, they must be cooled both from the standpoint of protecting the grit arrestor systems conventionally available and to lower them below the ignition point of the material they are to be used to dry. To this end, the products of combustion are led through a second chamber 27 which is formed or lined with refractory material and cooling air is introduced into this chamber through pipe 28 to reduce the temperature of the products of combustion to the order of about 1800° F. The resultant cooled gases are passed through a grit arrestor generally designated at 29 which entrains out any small particles 30 carried over with the products of combustion and these are collected in a hopper 31 where they may be taken off through the discharge chute 32 controlled by a valve 33 and if desired, recycled back into the combustion chamber. The grit arrestor 29 which may be any desired commercially available grit arrestor, is illustrated as comprising inverted channel shaped baffles 34 and vanes 35 spaced to provide a tortuous path to allow the gases to pass through to the outlet 36 while entraining out the carried over particles. The gases escaping from the outlet 36 may still be too hot for direct use in the kiln and therefore these gases are led into a third chamber 37 into which cooling air is admitted by the pipe 38 to reduce the gases to a temperature ranging from about 250° to 800° F and such lower temperature gases are delivered through the outlet 39 to the kiln (not shown).

Figure 2:
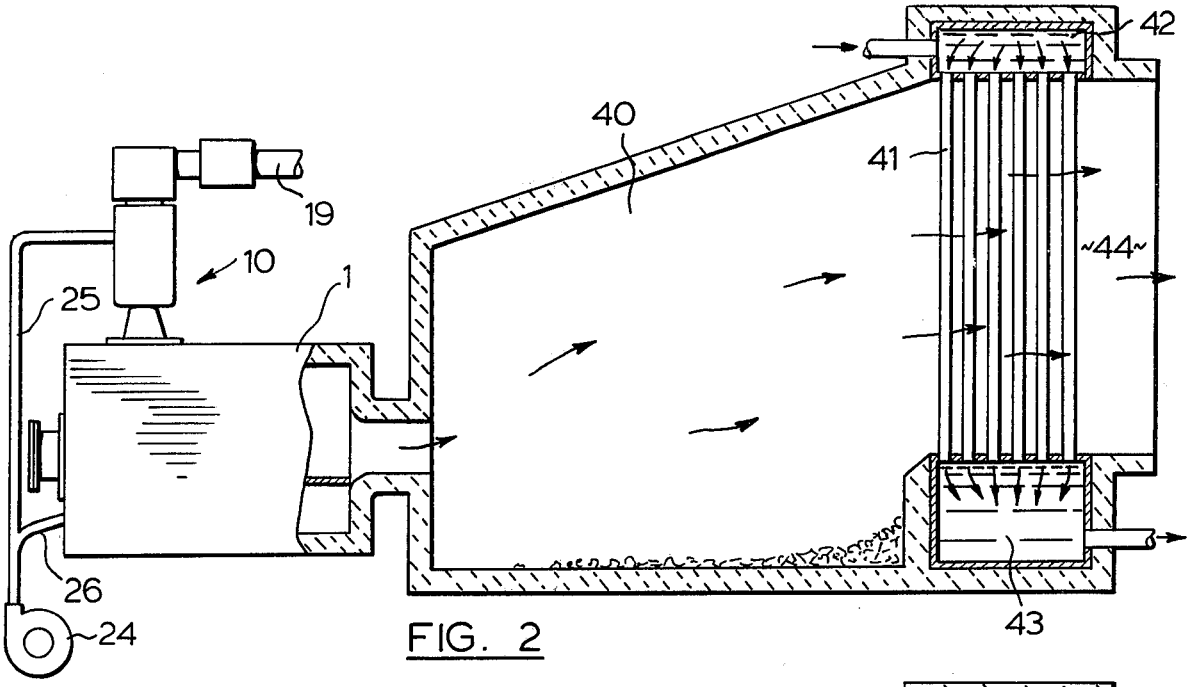
FIG. 2 is a view generally similar to FIG. 1 but showing the combustion chamber operating a water tube boiler.

FIG. 2 shows the combustion chamber 1 connected to the combustion chamber 40 of a water tube boiler wherein the hot products of combustion at about the 3000° F temperature are directed without cooling around the water tubes 41 through which water is circulated between the inlet reservoir 42 and the outlet reservoir 43. In this case the heat of the products of combustion is given up to the circulating water in generating steam and the resultant cooled products of combustion emanating from the boiler exit 44 may be led directly to a suitable pollution control device such as the grit arrestor 29 shown in FIG. 1 before being allowed to escape out of the stack (not shown). Chamber 40 which is also formed of refractory material or at least lined with such material, has been designated a combustion chamber in the sense that any entrained fine particles in the products of combustion emanating from the combustion chamber 1 may still be in a state of combustion under the high temperature gases until same are cooled by the yielding up of their heat values to the water recirculating in the water tubes.

Figure 3:
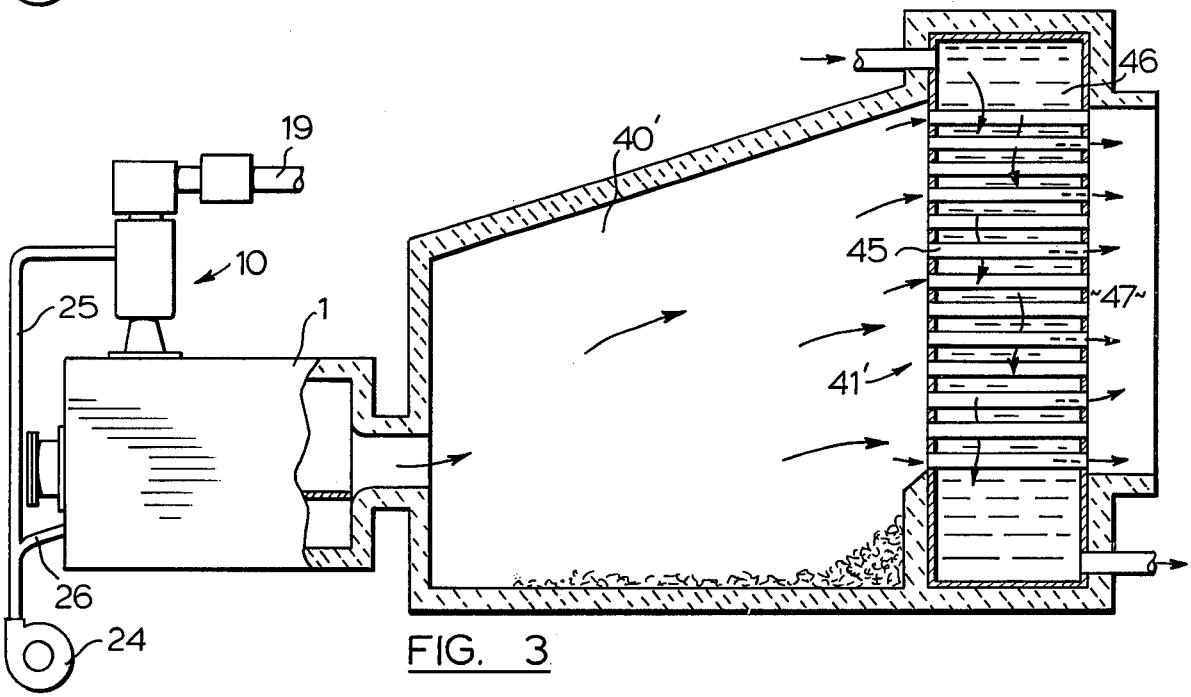
FIG. 3 is a view similar to FIG. 2 but showing the combustion chamber operating a fire tube boiler.

FIG. 3 shows an arrangement similar to FIG. 2 except that the products of combustion introduced into the combustion chamber 40' of the fire tube boiler 41' are led through tubes 45 leading through the boiler 46 before exiting at 47. Again, the products of combustion will have yielded up their heat to the surrounding water as they pass through the tubes 45 and they may be led directly to any suitable grit arrestor such as the grit arrestor illustrated at 29 in FIG. 1 and released through a suitable stack (not shown).

In both instances, FIGS. 2 and 3, the resulting emission from the boiler stacks will be substantially smokeless because of the completeness of the combustion which has taken place in the combustion chamber 1.

One of the benefits derived from the use of an air tight refractory chamber is the fact that when the fuel and air feed is shut off the temperature within the chamber remains above the volatilization and ignition temperature of at least some of the constituents of the fuel being used for a considerable period of time. Thus after a period which may even be up to several hours operation of the combustion chamber can be immediately recommenced by simply turned on the fuel and air feeds. This fact thus enables the operation of the combustion chamber to be automatically controlled through the normal conventional automatic controls to start and stop fuel and air fuel to suit the heat demand on the system.

While a specific combustion system and chamber therefor has been illustrated and described, it will of course be understood that various modifications in detail and structure as will be apparent to the man skilled in the art may be made within the spirit of the invention without departing from the scope of the appended claims.

I claim:

1. A combustion chamber capable of being directly fueled with green bark, green sawdust and the like material, said chamber being generally elongated and having a feed end and a discharge end, the interior of said chamber being formed of refractory material, said chamber having a grate therein at the feed end thereof disposed towards the bottom of the chamber, means for delivering particles of fuel material generally downwardly towards said grate while separating and enveloping the particles with pressurized swirling air; means for directing air upwardly through the grate against the downwardly directed air enveloped fuel particles in sufficient volume and with sufficient pressure and velocity to effect turbulent suspension of a substantial proportion of said fuel particles above the grate, the ratio of air to fuel introduced into said combustion chamber being at least about 7 to 1, said discharge end of said chamber forming a restriction, and said chamber being air tight apart from said fuel and air input feeds and said outlet whereby said chamber is adapted to operate on a positive pressure with respect to the external ambient pressure.

2. A combustion system for wet fuel such as green bark, saw dust and the like, comprising an elongated combustion chamber having an interior formed of refractory material and having a feed end and a discharge end and a grate adjacent the feed end disposed towards the bottom of the chamber, means for feeding particles of wet fuel separated and enveloped in a turbulent pressure air stream generally downwardly towards said grate with the interior of the chamber operating at a positive pressure with respect to the ambient external pressure and at a temperature above the volatilization and ignition temperature of at least some of the constituents of the fuel particles, and means for directing up through said grate a stream of air having sufficient volume, pressure and velocity to maintain a substantial portion of the fuel particles in turbulent suspension above the grate for a time sufficient to initiate volatilization and ignition of at least the most volatile of the particle constituents containing B.T.U. values to initiate a temperature increasing chain reaction like ignition of other volatilizable B.T.U. constituents until the solid constituents ignite, the ratio of air to fuel introduced into the combustion chamber being at least about 7 to 1.

3. A combustion system as claimed in claim 2 in which the volume of air directed upwardly through the grate is substantially greater than the volume of air introduced with said wet fuel particles.

4. A combustion system as claimed in claim 3 in which the products of combustion from said combustion chamber are cooled, led through a grit arrestor and introduced into a drying kilm.

5. A combustion system as claimed in claim 3 in which the products of combustion from said combustion chamber are used to fire a water tube boiler.

6. A combustion system as claimed in claim 3 in which the products of combustion from said combustion chamber are used to fire a fire tube boiler.

7. A combustion system as claimed in claim 2 in which said means for feeding particles of wet fuel comprises an air pressure fuel feed line controlled by an air pressure operated valve for delivering fuel through a mixing annulus opening through the combustion chamber above the grate, and means for introducing pressure air peripherally into the mixing annulus in a generally tangential direction to effect swirling of the fuel particles while separating and engulfing same as they are delivered into the combustion chamber generally downwardly towards said grate.

8. A combustion system for wet fuel such as green bark, saw dust and the like, comprising an elongated combustion chamber having an interior formed of refractory material and having a feed end and a discharge end and a grate adjacent the feed end disposed towards the bottom of the chamber, means for feeding particles of wet fuel separated and enveloped in a turbulent pressure air stream generally downwardly towards said grate with the interior of the chamber operating at a positive pressure with respect to the ambient external pressure and at a temperature above the volatilization and ignition temperature of at least some of the constituents of the fuel particles, and means for directing up through said grate a stream of air having sufficient volume, pressure and velocity to maintain a substantial portion of the fuel particles in turbulent suspension above the grate for a time sufficient to initiate volatilization and ignition of at least the most volatile of the particle constituents containing B.T.U. values to initiate a temperature increasing chain reaction like ignition of other volatilizable B.T.U. constituents until the solid constituents ignite, said means for feeding particles of wet fuel comprising an air pressure fuel feed line controlled by an air pressure operated valve for delivering fuel through a mixing annulus opening through the combustion chamber above the grate, and means for introducing pressure air peripherally into the mixing annulus in a generally tangential direction to effect swirling of the fuel particles while separating and engulfing same as they are delivered into the combustion chamber generally downwardly towards said grate.

9. A combustion chamber capable of being directly fueled with green bark, green sawdust and the like material, said chamber being generally elongated and having a feed end and a discharge end, the interior of said chamber being formed of refractory material, said chamber having a grate therein at the feed end thereof disposed towards the bottom of the chamber, means for delivering a stream of particles of fuel material into said chamber and generally downwardly towards said grate while separating and enveloping the particles with pressurized turbulent air outside said chamber by directing pressure air generally tangentially into the fuel particle stream; means for directing air upwardly through the grate against the downwardly directed air enveloped fuel particles in sufficient volume and with sufficient pressure and velocity to effect turbulent suspension of a substantial proportion of said fuel particles above the grate, said discharge end of said chamber forming a restriction, and said chamber being air tight apart from said fuel and air input feeds and said outlet whereby said chamber is adapted to operate on a positive pressure with respect to the external ambient pressure.

* * * * *